United States Patent [19]

Brown et al.

[11] 4,291,070

[45] Sep. 22, 1981

[54] COATING OF PARTICLES

[75] Inventors: Stuart R. Brown, Reading; Eric A. Feest, Wallingford; Fred Leach, Wantage, all of England

[73] Assignee: United Kingdom Atomic Energy Authority, London, England

[21] Appl. No.: 208,775

[22] Filed: Nov. 20, 1980

[30] Foreign Application Priority Data

Dec. 5, 1979 [GB] United Kingdom ..... 42058/79

[51] Int. Cl.[3] ..... B05D 7/00

[52] U.S. Cl. ..... 427/213; 75/130 R; 75/251

[58] Field of Search ..... 427/213; 75/130 R, 251

[56] References Cited

U.S. PATENT DOCUMENTS

| | | | |
|---|---|---|---|
| 2,481,599 | 9/1949 | Kengel | 75/93 G |
| 2,552,204 | 5/1951 | Morrosh | 75/130 R |
| 3,527,597 | 9/1970 | Dawson | 75/130 R |

*Primary Examiner*—Sam Silverberg

*Attorney, Agent, or Firm*—Larson and Taylor

[57] ABSTRACT

The invention relates to the coating of particles for use, for example, as inoculants in the metallurgical field.

A fluidized bed of metallic-particles (e.g. Fe/Si, Fe/Mn of size range 50 μm to 3000 μm or higher) is contacted with a wash-coat comprising a suspension of a non-dispersible ceramic powder in a sol (e.g. a suspension of $Al(OH)_3$ powder in a boehmite sol). Subsequent controlled drying and firing produces a ceramic coating on the particles which has good adhesion and thermal stability and whose thickness and density can readily be controlled.

5 Claims, No Drawings

COATING OF PARTICLES

This invention relates to a method of coating metallic-particles with a ceramic material.

There is a requirement in the metallurgical field for coated metallic-particles in sizes in the range, for example, from 50 μm to 600 μm. Such particles are required, for example, as inoculants for addition to a melt where the coating protects the particles from a too rapid dissolution into the melt. The coating must therefore be of sufficient coherence, density and thermal stability to inhibit or delay dissolution into the melt. We have now devised a method of coating metallic-particles which give a product which meets these criteria and which may also be suitable for other applications where such a coating is required.

The present invention provides a method of coating metallic-particles with a ceramic material which comprises generating a fluidised bed of the metallic-particles; contacting the metallic-particles in the bed with a wash-coat comprising a suspension of a non-dispersible ceramic powder in a sol of colloidal-particles convertible to the ceramic material thereby to coat the metallic-particles with the ceramic-particles and the colloidal-particles; and subsequently firing to produce a coating of the ceramic material.

We have found that this method enables coatings of controlled density, thickness and adhesion to be produced in an operation which has potential for scale-up. Moreover, the method may enable coated particles to be produced in batches with insignificant agglomeration of the particles and produces coatings which are resistant to thermal shock.

We attribute the success of our method to the use of the above wash-coat in combination with the use of a fluidised bed technique. Thus, if a sol lacking the non-dispersible powder were used, the large volume change on drying and firing would give rise to a poorly adherent and mechanically weak coating. The colloidal-particles in the sol interact with non-dispersible powder to produce a coating of controlled integrity in a way which would be impossible if, say, a pure solution were used together with the non-dispersible powder. The use of a fluidised bed technique, in addition to providing operational advantages, inhibits agglomeration of particles and enables coatings of even thickness to be applied. This is because the wash-coat dries almost instantaneously when it touches the particles and because static inter-particle contact is minimised in a fluidised bed.

The method of the invention may be applied to any metallic-particles on which it is desired to provide a coating. The metal may, for example, be a metal suitable for use as a melt additive such as ferrosilicon, ferromanganese and chromium. The particle size may be within a wide range, for example, from 50 μm to 5 mm provided, of course, that a fluidised bed of the metallic particles can be generated. We are, however, most interested in the size range from 50 μm to 600 μm since this represents a preferred size range for certain melt additive applications.

The ceramic material is most preferably a ceramic oxide such as alumina, silica, titania, zirconia, ceria or chromia or may be a mixture of ceramic oxides. In such cases the wash-coat used comprises a suspension of non-dispersible ceramic oxide powder in a sol of colloidal-particles convertible to the ceramic oxide. The ceramic material may also be a compound oxide such as zircon or may be a mixture of a ceramic oxide with another ceramic material. In an example of the latter case, the wash coat used may comprise a suspension of a non-dispersible ceramic material powder, e.g. a cement such as calcium aluminium silicate, in a sol of colloidal-particles convertible to a ceramic oxide such as alumina. Suitable powders in the wash coats are commercially available ceramic oxide powders, specific examples of which are given hereinafter. The particle size of the powder is one of the factors controlling the thickness of the coating in that a coarser powder produces a thicker, less dense coating than a finer powder. If it is desired to increase the packing density of the coating, the powder in the wash-coat may be constituted by particles having two or more different particle sizes, for example 5 μm and 0.5 μm.

Examples of sols which may be used are a boehmite sol as described in U.K. Pat. No. 1,174,648, an alumina sol as described in West German OLS No. 2 647 701, a ceria sol as described in International Patent Application Publication No. WO/79/00248, a titania sol as described in U.K. Patent No. 1,412,937 and a silica sol believed to be made by hydrolysis of sodium silicate and sold commercially by Monsanto under the trade name of 'Syton'.

We generally prefer that the wash-coat contains a high proportion of powder since such wash-coats exhibit thixotropic as opposed to dilatant properties and are therefore more suitable for coating purposes. By "high" we mean greater than 80% by weight of the total ceramic material content of the wash-coat, i.e. the weight of the non-dispersible powder plus the weight of the colloidal particles. It is possible, however, to use wash-coats having a lower proportion of powder though we have generally found that the more dilute wash-coats are less stable with regard to their settling properties.

The metallic-particles may be contacted with the wash-coat by spraying the wash-coat into a fluidised bed of the metallic-particles, e.g. in a commercially available fluidised bed coating apparatus. An example of such a coating apparatus is manufactured by Aeromatic AG of Switzerland and, using a laboratory scale version of such an apparatus, we have been able to coat batches of ferro-silicon and ferro-manganese in the batch range from ½ to 5 Kg. When coating finer particles, we prefer to spray downwardly into the fluidised bed. However, when heavy, coarse particles are to be sprayed a strong fluidising air flow is required and we prefer to spray upwardly into the bed.

The invention will now be particularly described, by way of example only, as follows.

EXAMPLE 1

Preparation of wast-coat

A water-dispersible boehmite (39 g) prepared as described in U.K. Patent No. 1,174,648 was added slowly to water (1 l) with stirring and stirred for at least a further 30 minutes to give a boehmite sol. Commercially available non-dispersible aluminium hydroxide (Martifin, ex Croxton & Garry Ltd; 390 g., particle size 80% <0.5 μm) was added slowly to the sol with stirring and the pH adjusted to that before addition of the non-dispersible aluminium hydroxide by addition of nitric acid (7 M). The resulting wash coat was stirred for a further 1 hour and allowed to stand for 24 hours at room temperature. The pH was again adjusted, if necessary, to that before addition of the non-dispersible aluminium hydroxide by addition of nitric acid (7 M). The final pH was 3.5.

Coating of particles

A fluidised bed film coating apparatus supplied by Aeromatic AG of Switzerland was loaded with ferro-silicon (2 Kg; particle size > 500 μm). Heated air was passed up through the ferro-silicon to generate a fluidised bed thereof. The wash-coat prepared as above was sprayed upwardly into the fluidised bed so that the fluidised ferro-silicon particles were coated with a thin spray of the wash-coat which was dried almost instantaneously. Ideally, the rate of coating should be such that there is always insufficient liquid present to cause the ferro-silicon particles to agglomerate. The intermediate coated product was studied and found to have a thick coating (~50 μm) which had ahdered well and had only slight crazing.

The above product was then fired at 1000° C. for 1 hour to give the final coated particles. The resulting coating was found to have very good adhesion with some cracks.

EXAMPLE 2

The procedure of Example 1 was repeated but using ferro-manganese (particle size ~150 μm) instead of ferro-silicon. The intermediate product was found to be somewhat similar in respect of the coating to that obtained from the ferro-silicon with the exception that some particle agglomeration was exhibited. The coating in the final product was similar to that of the intermediate product; there was good adhesion with some crazing.

Other examples of non-dispersible commercially available oxides which may be used in the practice of our invention are: Kestel '600' amorphous silica, Linde B alumina, calcined RP ceria, though this list should not in any way be considered exhaustive.

We claim:

1. A method of coating metallic-particles with a ceramic material which comprises generating a fluidised bed of metallic-particles; contacting the metallic-particles in the bed with a wash-coat comprising a suspension of a non-dispersible ceramic powder in a sol of colloidal-particles convertible to the ceramic material thereby to coat the metallic-particles with the ceramic-particles and the colloidal-particles; and subsequently firing to produce a coating of the ceramic material.

2. A method according to claim 1 wherein the metallic-particles are of ferro-silicon, ferro-manganese or chromium.

3. A method according to claim 2 wherein the metallic-particles have a particle size within the range of 50 μm to 600 μm.

4. A method according to claim 1 wherein the ceramic material is a ceramic oxide.

5. A method according to claim 1 wherein the wash-coat contains greater than 80% by weight of the non-dispersible powder based on the total ceramic content thereof.

* * * * *